US005501582A

United States Patent [19]

Gautier et al.

[11] Patent Number: 5,501,582

[45] Date of Patent: Mar. 26, 1996

[54] MAGNETICALLY DRIVEN CENTRIFUGAL PUMP

[75] Inventors: Pascal Gautier, Grenoble; Gilles Braussen, Longeville les Metz; Bernard Gouthier, Thiaucourt; Ghislaine Deswert, Pagny-sur-Moselle; Ernest Totino, Sainte Ruffine, all of France

[73] Assignee: Le Carbone Lorraine, Courbevoie, France

[21] Appl. No.: 377,435

[22] Filed: Jan. 24, 1995

[30] Foreign Application Priority Data

Jan. 26, 1994 [FR] France ..... 94 01104

[51] Int. Cl.[6] ..... F04B 17/00

[52] U.S. Cl. ..... 417/420; 417/423.12; 415/110; 415/172.1

[58] Field of Search ..... 417/420, 423.1, 417/423.12, 423.11; 415/110, 170.1, 172.1

[56] References Cited

U.S. PATENT DOCUMENTS

| | | | |
|---|---|---|---|
| 4,780,066 | 10/1988 | Bolleter et al. | 417/420 |
| 4,793,777 | 12/1988 | Hauenstein | 417/420 |
| 4,806,080 | 2/1989 | Mizobuchi et al. | 417/423.12 |
| 5,017,103 | 5/1991 | Dahl | 417/420 |
| 5,201,642 | 4/1993 | Hinckley | 417/420 |
| 5,248,245 | 9/1993 | Behnke | 415/110 |
| 5,324,177 | 6/1994 | Golding et al. | 417/423.1 |
| 5,405,251 | 4/1995 | Sipin | 417/420 |

FOREIGN PATENT DOCUMENTS

| | | |
|---|---|---|
| 0250856 | 1/1988 | European Pat. Off. . |
| 3413930 | 10/1985 | Germany . |
| 2263312 | 1/1993 | United Kingdom . |

*Primary Examiner*—Charles Freay
*Attorney, Agent, or Firm*—Dennison, Meserole, Pollack & Scheiner

[57] ABSTRACT

A magnetically drive centrifugal pump comprises a fixed assembly formed by a pump barrel made of a carbonaceous material, rigid annular bearings and a non-magnetic, non-electrically conductive sealing shell, and a rotating assembly formed by an impeller made of a carbonaceous material, a cylindrical rotor made of a carbonaceous material and having sealed therein permanent tracking magnets. The rotor is fixed directly to the impeller to form an impeller-rotor assembly which rests on the annular bearings. The driver includes magnets which interact with the permanent tracking magnets of the rotor in order to drive the pump, the driver being isolated from the impeller-rotor assembly by the sealing shell. The impeller-rotor assembly includes a secondary circuit for circulation of transported fluid located between the impeller-rotor assembly and the sealing shell.

15 Claims, 5 Drawing Sheets

MAGNETICALLY DRIVEN CENTRIFUGAL PUMP

FIELD OF THE INVENTION

The invention relates to centrally magnetically driven centrifugal pumps, particularly pumps made from carbonaceous material and pumps for transportation of hot and/or corrosive and/or toxic and dangerous fluids.

DESCRIPTION OF RELATED ART

Magnetically driven centrifugal pumps have as their basic components a pump barrel, an impeller, a magnetic driving device and assembly and connection members.

FIG. 1 shows schematically the composition of a known pump of this type.

The pump barrel 4 is provided with an inlet port 12, a pumping compartment 22 and an outlet port 13. The pump barrel 4 may be formed from several parts.

The magnetic driving device is composed of a rotor 23 and a driver 24. The driver consists of a drive wheel 14 which is provided with permanent motor magnets 3 and which is fixed to the shaft 2 of a motor.

At least two types of magnetic drive are recognised, that is to say with a peripheral driver, or with a central driver. In the first, and most usual, case the drive wheel 14 surrounds the rotor 23, whereas in the second case, which is relevant to the present application, it is situated inside the rotor.

The rotor 23 is fixed to the impeller 5, most usually by means of a common shaft and by screwing, such that it forms an integral impeller-rotor assembly.

The rotor is provided with tracking elements 6 which are either permanent magnets, called tracking magnets, or parts made from material with high magnetic permeability, called tracking parts, or a combination of the two. The motor magnets 3 and the tracking elements 6 are generally disposed opposite each other and distanced apart such as to provide a sufficient driving torque.

The stability and centering of the parts during rotation is ensured by one or more internal or external axial bearing(s) 8, provided or not provided with bushes 9. A specific lubrication device 10 and lubricant are often necessary, but it is known to be able to ensure lubrication of the bearings with the aid of the transported fluid (self-lubricating pumps). As described in DE-3413930 and US-5201642 and application GB-2263312, self-lubrication is obtained with the aid of a secondary circuit which provides for the circulation of the transported fluid through a small clearance at the level of the bearings and/or through backstream passages 25 in the fixed and/or moveable parts.

The pumping compartment 22 occupies a volume internally closed by an interstitial sealing shell 7. The driver 24 and the motor are located outside the pumping compartment and are thus isolated from the transported fluid, which circulates only in the pumping compartment 22. The wall of the sealing shell 7 is generally thin and configured so as to fit into the gap in the driving device, that is to say in the space which separates the motor magnets 3 from the tracking elements 6.

One of the main preoccupations of magnetically driven centrifugal pump manufacturers is resistance to the fluid transported, that is to say temperature resistance and resistance to the chemical corrosiveness of the transported fluids.

With respect to this, apart from introducing an interstitial sealing shell it is known from DE-3413930 and US-4645433 to use materials offering good physico-chemical resistance to the fluid transported.

Pumps in particular for the chemical, chemical-related and pharmaceutical industries most often form an integral part of complex devices. For this, apart from the requirement that they be resistant to the transported fluid, they must meet a certain number of complementary requirements of a technical, and above all of an economic nature, in particular in order to reduce maintenance costs and limit production stoppages.

These complementary requirements comprise in particular:

high stability and perfect balance during rotation;

as compact a construction as possible;

as limited a number of parts as possible;

very easy assembly and disassembly.

The pump described in DE-3413930 is resistant to the transported fluids, but it is known that pumps with a common shaft are difficult to service because of the particular fitting of the parts.

In general it is well known that it is difficult for pumps with a common shaft to be compact, In certain cases, the rotor is cantilevered with respect to the impeller (US-5201642) or with respect to an axle in the input port of the pump (US-4645433). It is known that these configurations allow a slight radial displacement, which is a source of vibration and possibly of additional friction. These undesirable effects are accentuated at high temperatures, particularly by the effect of differential expansion between the constituent parts.

Additionally, although US-4645433 describes a pump, the driving device of which has a reduced volume, the inlet section is greatly reduced by the presence of the rotation axle which considerably increases the head loss and the NPSH (Net Positive Suction Head) required and which consequently increases the risk of erosion of the impeller by cavitation. Moreover, this configuration requires a specific independent lubrication.

Having established the lack of a satisfactory known solution, applicants have sought to manufacture a magnetically driven centrifugal pump which satisfies all of the industrial requirements described above.

SUMMARY OF THE INVENTION

Figure 1:
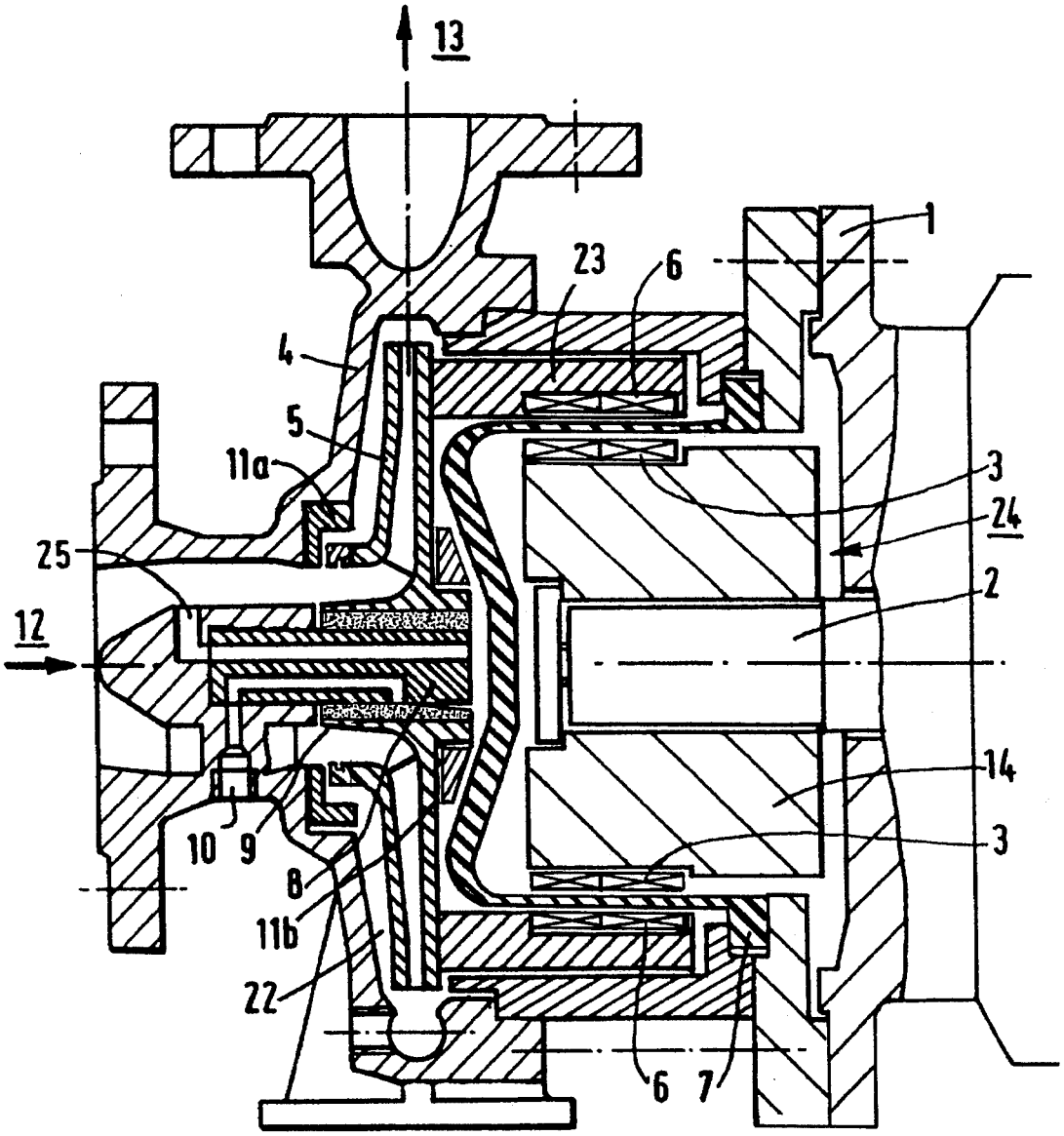
FIG.1 PRIOR ART
FIG. 1 shows an axial section of a centrally magnetically driven centrifugal pump according to the prior art, with an impeller 5 supported by an axial bearing 8 and provided with thrust bearings 11a and 11b and a lubrication device 10.

The magnetically driven centrifugal pump according to the invention comprises a pump barrel 4, an impeller 5, a rotor 23, a sealing shell 7 and a driver 24, and assembly and connecting members, and is characterised in that the driver is central, in that the pump barrel 4 is made of a carbonaceous material, particularly of graphite, in that the sealing shell 7 is made of non-magnetic and electrically non-conductive material, in that permanent tracking magnets 6 are integral with the rotor 23 and completely isolated from the fluid transported, in that the rotor 23 is cylindrical in shape and is directly fixed to the impeller 5 without any intermediate parts such as to form a compact impeller-rotor assembly, in that the impeller-rotor assembly is made of a carbonaceous material of the same nature as that of the pump barrel 4, in that the impeller-rotor assembly rests only upon two external rigid axial annular bearings 16 and 17 located at the extremities of said assembly in the axial direction, and in that the impeller-rotor assembly is provided with a secondary circuit allowing the circulation of a part of the transported fluid at the rear of said assembly and between it and the sealing shell 7.

The sealing shell 7 is preferably made of a composite material including in particular carbonaceous products and/or polymerised resins.

The secondary circuit consists preferably of an axial hole 19 in the impeller 5 or of a series of holes 26 in the impeller 5 symmetrically disposed about the axis of rotation of the impeller-rotor assembly.

The tracking magnets 6 are preferably made integral with the impeller-rotor assembly by bonding on of a cap 31 comprising an annular cavity 32. According to a variation of the invention, complementary parts 28 and/or 29 are placed in the cavity 32 complementing the tracking magnets 6. The parts 28 and/or 29, which can be of a magnetic or non-magnetic material, allow exact positioning of the tracking magnets 6 and/or confinement of the magnetic field lines.

A suitable expansion joint which preferably is composed of expanded graphite can be placed in the remaining expansion space 33 in order to wedge the magnets and to absorb the differential expansion.

According to a variation of the invention, the impeller-rotor assembly abuts againsts a thrust bearing 18 on the side of the inlet port 12.

The bearings 16, 17 and 18 are preferably made of a carbonaceous material, particularly of graphite, or of siliconised graphite or of silicon carbide.

Preferably, the impeller-rotor assembly rests directly upon the external bearings 16 and 17, without bushes being fixed to said assembly.

The part of the transported fluid circulated in the pumping compartment by the secondary circuit not only allows the self-lubrication of the rear bearing, but also avoids the use of a second thrust bearing for the rear bearing by virtue of a liquid bearing effect and limits the pressure upon the rear of the impeller-rotor assembly which reduces wear and tear on the front thrust bearing.

The fact that the tracking magnets are isolated within the barrel of the rotor not only allows avoidance of the magnets being etched by the transported fluid, but also allows benefit to be obtained from the tribologic properties of the carbonaceous materials constituting the impeller-rotor assembly.

The assembly and disassembly operations for the pump according to the invention are carried out by simple packing and fitting of the constituent parts. The motor may be taken out without removing the pump of the device to which it is attached, that is to say that the transported fluid can remain in the pumping compartment during this operation.

The number of parts of the pump according to the invention is greatly reduced which simplifies maintenance and reduces the costs thereof.

The pump according to the invention also has the advantage of a high degree of adaptability to very varying conditions of use, particularly with respect to pressure and discharge rate.

During tests, as will be shown in the examples, the applicant established that the pump according to the invention offers good performance, particularly with respect to the characteristics curve, resistance to corrosion, reliability, mechanical stability and impeller-rotor centering.

These results are attributed to the advantageous combination of a compact impeller-rotor assembly, that is to say short with respect to its diameter, and of large diameter external bearings on the extremities. It is also hypothesised that the liquid bearing effect between the impeller-rotor assembly and the sealing shell plays an important role in the mechanical stability of the pump.

The invention will be better understood with the aid of the embodiments illustrated in FIGS. 2 to 5.

EXAMPLES

Figure 2:
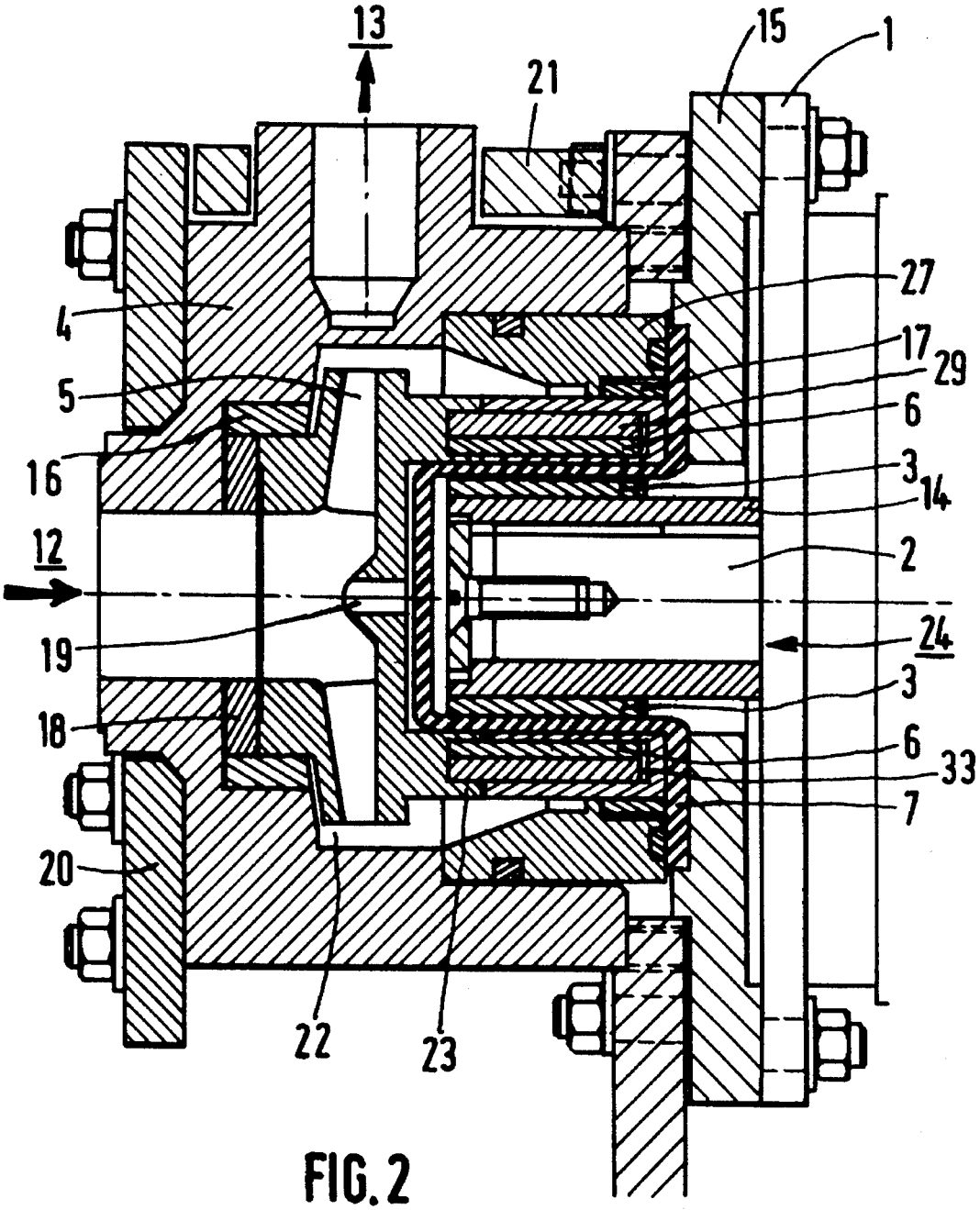
FIG. 2 shows an axial section of a centrally magnetically driven centrifugal pump according to the invention which corresponds to Example 1.

Example 1 (FIG. 2)

A pump according to the invention was produced, comprising a drive motor onto the shaft 2 of which the drive wheel 14 provided with motor magnets 3 was attached, a graphite pump barrel 4, an impeller-rotor assembly the annular cylindrical extension of which comprises tracking magnets 6 located opposite motor magnets 3, a rear intermediary part 27 and a sealing shell 7.

Figure 4:
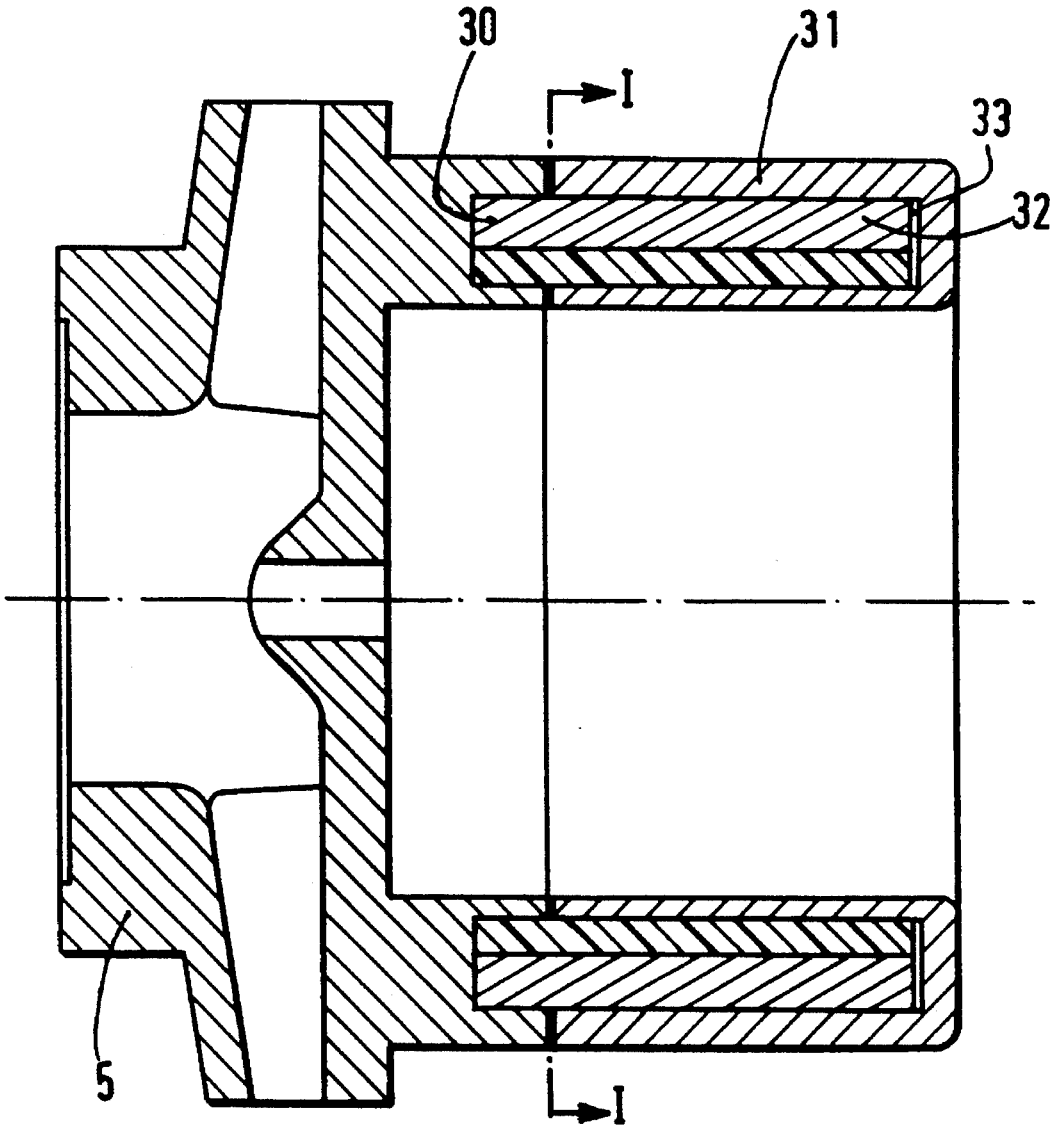
FIG. 4 shows an axial section of a device for fixing the permanent tracking magnets according to the invention, which permits isolation of the magnets from the transported fluid. Sealed fixing is obtained by bonding, in plane I—I of the impeller-rotor assembly having an annular cavity 30, of a cap 31 provided with a complementary annular cavity 32.

Sealed fixing of the tracking magnets onto the impeller-rotor assembly was achieved by bonding of a cap 31 onto said assembly according to the plane I—I using a cement based on graphite, phenol resin and catalyst (FIG. 4). A complementary part 29 consisting of a steel ring was inserted in the cavity 32. The remaining space 33 was filled with expanded graphite such as to form an expansion joint.

The impeller-rotor assembly bore externally on the one hand upon the pump barrel 4 and on the intermediary part 27 by means of two rigid external axial annular bearings 16 and 17 located at the two extremities of the impeller-rotor assembly in the direction of the axis and on the other hand upon a thrust bearing 18 located on the side of the inlet port 12. The bearings 16, 17 and 18 were made of siliconised graphite and silicon carbide.

The impeller-rotor assembly comprised an axial hole 19 in the impeller 5.

The bearing 17 rested upon an intermediary part 27 provided with two sealing joints.

The sealing shell 7 was produced from a resin—carbon-fibre composite material Rigilor® from Le Carbone Lorraine.

The pump barrel 4, which was made in a single piece having an inlet port 12 and an outlet port 13, was fixed to the flange 1 of the motor by means of an assembly plate 15 upon which the sealing shell 7 was fixed.

The pump comprised an inlet flange 20 and an outlet flange 21.

This pump was tested with several chemical processes and gave complete satisfaction. In particular the characteristics curve, resistance to corrosion and reliability were excellent. No problems occurred with respect to mechanical stability or centering of the spinner-rotor assembly, even in high temperature conditions.

Figure 3:
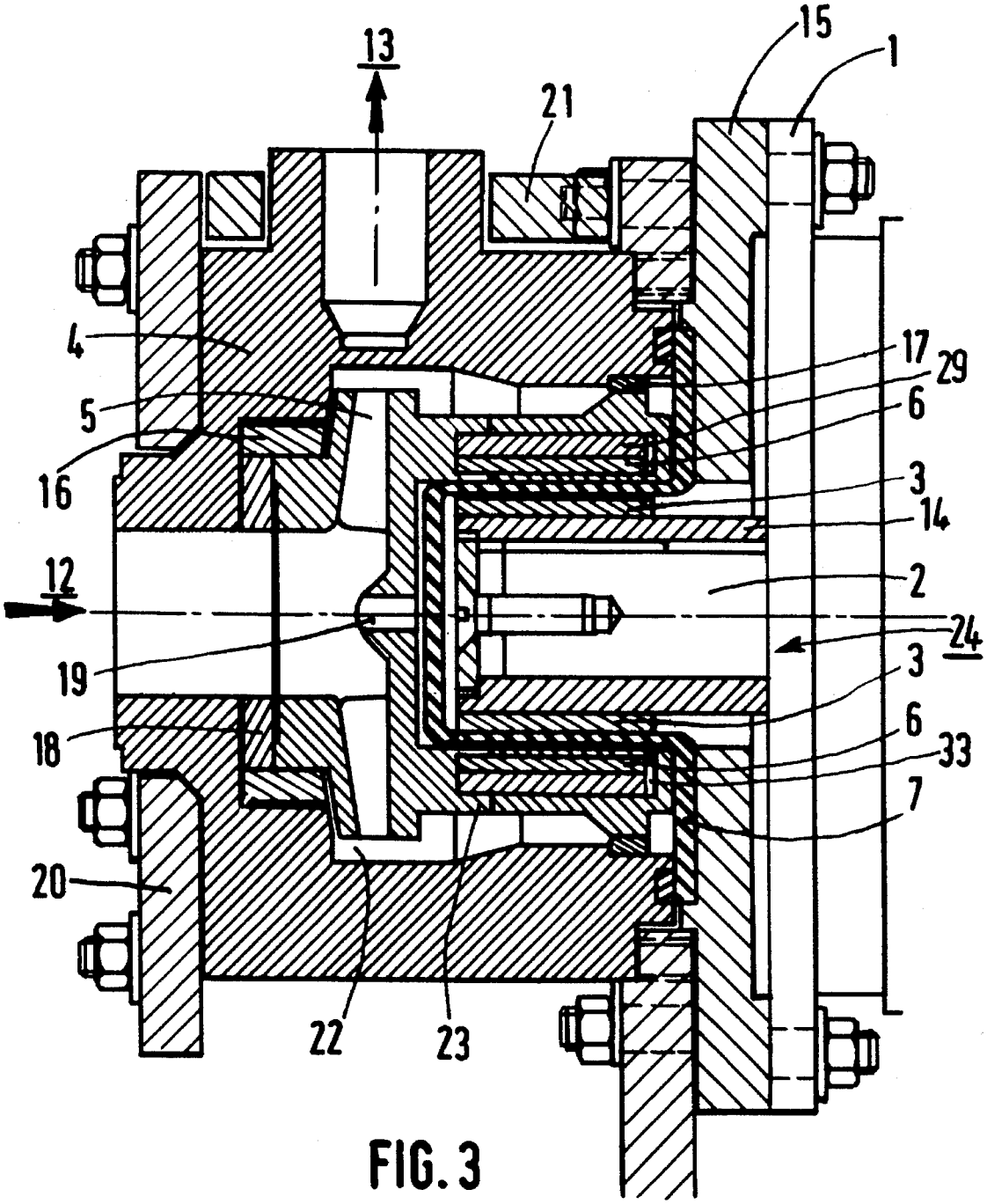
FIG. 3 shows a second embodiment of the pump according to the invention which corresponds to Example 2.

Example 2 (FIG. 3)

A second pump according to the invention was produced according to example 1, except for the bearing 17 which rested directly upon the pump barrel 4, which allowed elimination of the intermediate part 27 and one of the corresponding joints.

This pump was tested with several chemical processes and gave complete satisfaction, particularly with respect to the characteristics curve, resistance to corrosion, reliability, mechanical stability and centering of the impeller-rotor assembly, even in high temperature conditions.

Figure 5:
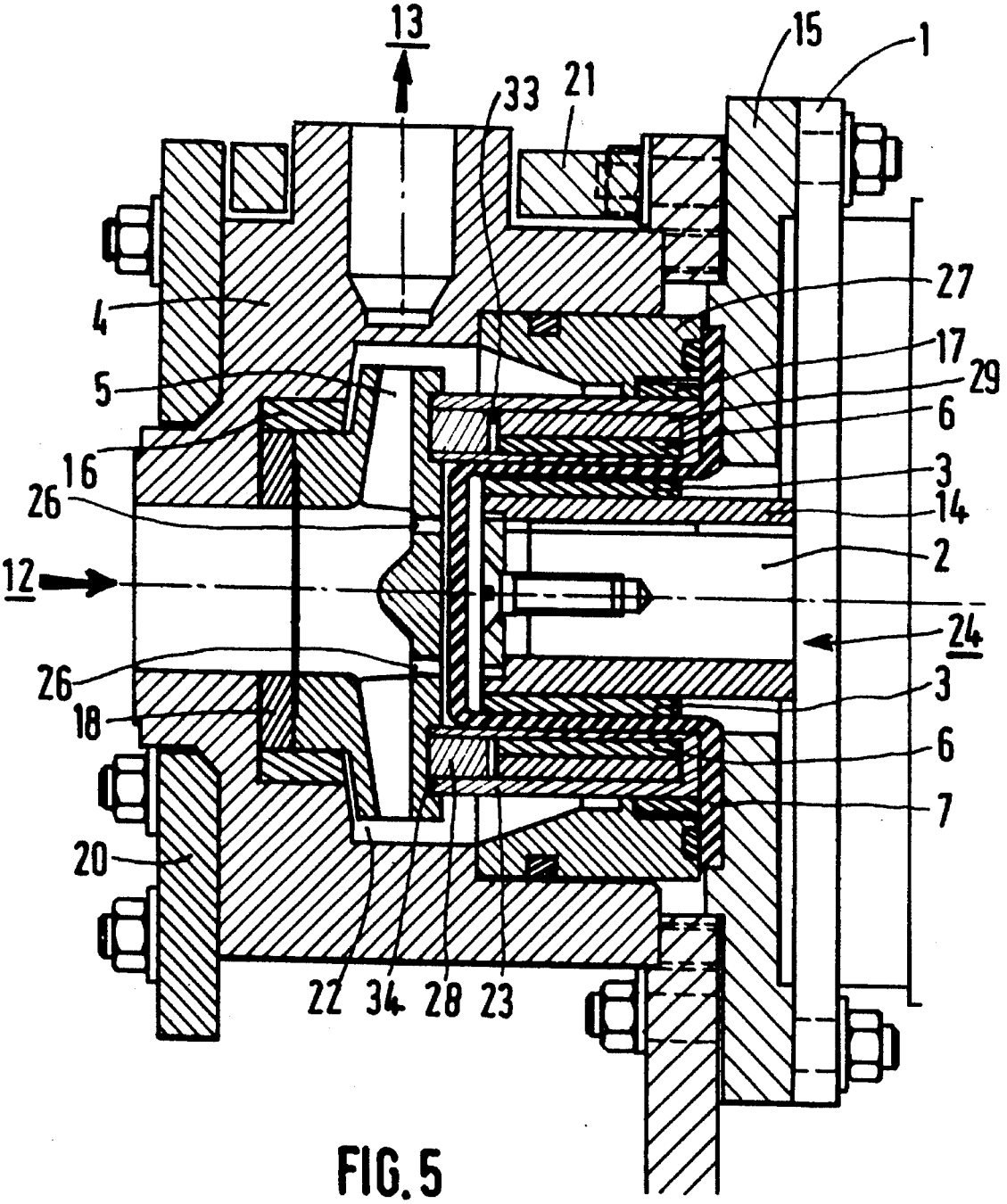
FIG. 5, shows a third embodiment of the pump according to the invention which corresponds to Example 3.

Example 3 (FIG. 5)

A third pump according to the invention was produced according to example 1, except for the secondary circuit which comprised a series of holes 26 disposed symmetrically about the axis of rotation at the level of the impeller, and the cap 31 containing the tracking magnets which were inserted into an annular cavity 34 in the impeller. A second complementary part 28 made of graphite and having an annular shape was placed in the annular cavity 32 of the cap 31.

This pump was tested with several chemical processes and gave complete satisfaction, particularly with respect to the characteristics curve, resistance to corrosion, reliability, mechanical stability and centering of the impeller-rotor assembly, even in high temperature conditions.

What is claimed is:

1. Magnetically driven centerifugal pump comprising:

a) a fixed assembly comprising a pump barrel made of a carbonaceous material and having an inlet port and an outlet port therein for flow of fluid therethrough, rigid annular bearings and a non-magnetic, non-electrically conductive sealing shell; and b) a rotating assembly comprising an impeller made of a carbonaceous material, a cylindrical rotor made of a carbonaceous material and having sealed therein permanent tracking magnets which are thereby isolated from transported fluid, said rotor being fixed directly to the impeller to form an impeller-rotor assembly which rests on said annular bearings located at axial extremities of said impeller-rotor assembly, and a driver centerally located with respect to said impeller-rotor assembly and comprising magnets disposed for interacting with said permanent tracking magnets for rotating said impeller-rotor assembly, said sealing shell isolating said driver from said impeller-rotor assembly;

said impeller-rotor assembly comprising a secondary circuit for circulation of transported fluid including a space defined between said impeller-rotor assembly and said sealing shell.

2. Pump according to claim 1, wherein said carbonaceous material is graphite.

3. Pump according to claims 1, wherein the impeller-rotor assembly abuts against a thrust bearing adjacent the inlet port.

4. Pump according to claim 1, wherein the impeller-rotor assembly rests directly upon annular bearings without bushes being fixed to said-assembly.

5. Pump according to claim 1, wherein the sealing shell is made of a composite material comprising carbonaceous products, polymerised resins, or mixtures thereof.

6. Pump according to claim 1, wherein the secondary circuit comprises an axial hole in the impeller.

7. Pump according to claim 1, wherein the secondary circuit comprises a plurality of holes in the impeller disposed symmetrically about an axis of rotation of the impeller-rotor assembly.

8. Pump according to claim 1, wherein the bearings are made of a material selected from the group consisting of graphite, siliconised graphite and silicon carbide.

9. Pump according to claim 1, wherein the permanent tracking magnets are sealed within the rotor by a cap comprising an annular cavity bonded to the rotor.

10. Pump according to claim 9, additionally comprising complementary parts disposed in the annular cavity for positioning said permanent tracking magnets.

11. Pump according to claim 1, wherein the rotor is provided with an expansion joint between the rotor and the permanent tracking magnets.

12. Pump according to claim 11, wherein said joint is made of expanded graphite.

13. Pump according to claim 1, wherein an expansion space is defined adjacent said permanent tracking magnets sealed within said rotor, and an expansion Joint is provided within said expansion space.

14. Pump according to claim 9, additional comprising complementary parts disposed in the annular cavity for confining magnetic field lines of the permanent tracking magnets.

15. Pump according to claim 1, wherein said secondary circuit includes one of said annular bearings which is adjacent said rotor.

* * * * *